United States Patent [19]

Arioli et al.

[11] 3,968,664

[45] July 13, 1976

[54] APPARATUS FOR FINAL IMMERSION WASHING OF FABRICS

[76] Inventors: Amedea Arioli; Lorenza Arioli, both of Via Cristoforo Colombo 20, 21040 Gerenzano, Italy

[22] Filed: July 25, 1974

[21] Appl. No.: 491,868

[30] Foreign Application Priority Data

July 27, 1973 Italy ..... 27195/73

[52] U.S. Cl. ..... 68/22 R; 68/175; 68/158

[51] Int. Cl.[2] ..... D06F 29/00; D06F 35/00; D06F 3/00

[58] Field of Search ..... 68/158, 9, 27, 22 R; 26/51.3, 51.4, 51.5, 63; 198/163, 169

[56] References Cited

UNITED STATES PATENTS

| | | | |
|---|---|---|---|
| 1,246,993 | 11/1917 | Payet | 68/158 |
| 3,041,703 | 7/1962 | Prell | 26/51.5 |
| 3,204,109 | 8/1965 | Goodwin | 26/51.5 X |
| 3,243,978 | 4/1966 | Gowin | 26/63 X |
| 3,606,772 | 9/1971 | Sando et al. | 68/22 R X |
| 3,646,785 | 3/1972 | Arioli | 68/175 |

*Primary Examiner*—Richard E. Aegerter
*Assistant Examiner*—Larry Jones
*Attorney, Agent, or Firm*—Michael J. Striker

[57] ABSTRACT

An apparatus for the continuous immersion washing of uninterrupted pieces of fabrics, particularly of knitted fabrics, progresses the length of fabric through a series of washing stations including immersion washing tanks and progressing mechanisms including fabric widening rollers. At least one immersion washing tank has an intermittently driven rotary member partially immersed therein and having circumferentially distributed first projections which form a platform with second projections distributed along endless sprocket chams which drive the rotary member. Portions of the fabric are fed and loosely folded in relaxed tensionless condition onto the platform. A pair of axially-aligned, independently-driven and controlled half rollers exert transverse pulls on the fabric to counteract and correct misalignments detected and signalled by sensor means located downstream of the immersion washing tank.

11 Claims, 7 Drawing Figures

60 - 62

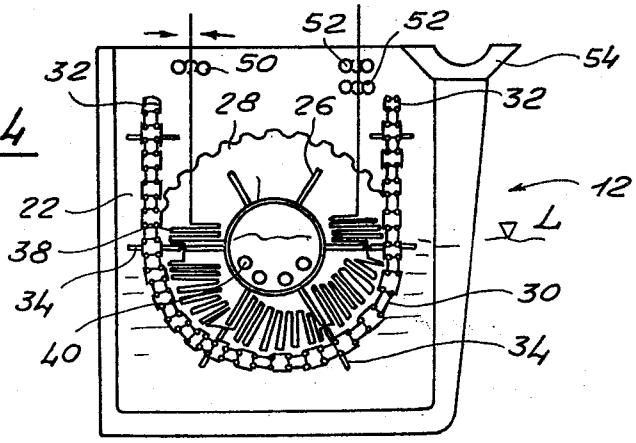
Fig. 4
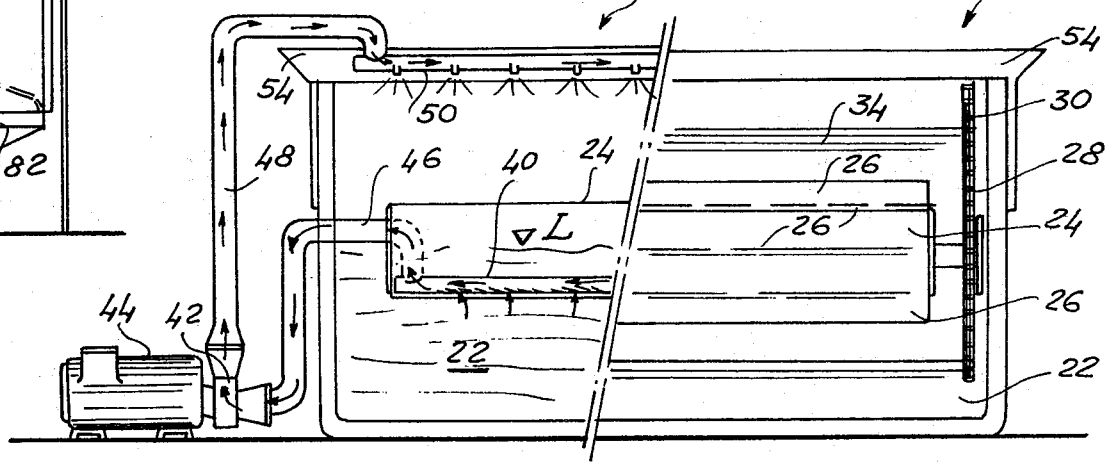
Fig. 5B
Fig. 5A
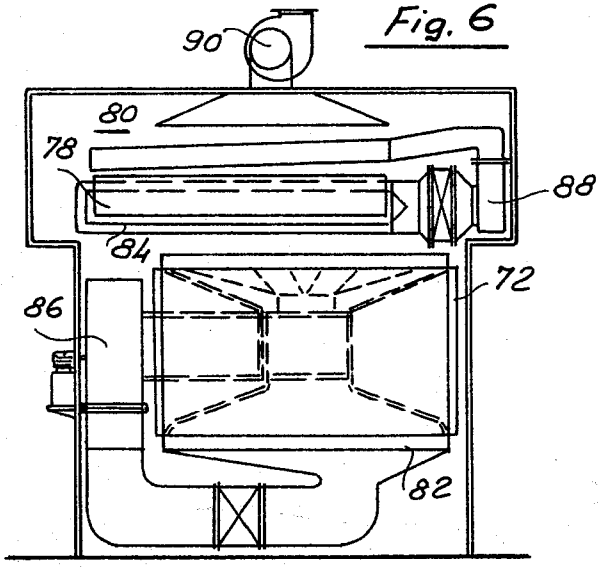
Fig. 6

APPARATUS FOR FINAL IMMERSION WASHING OF FABRICS

BACKGROUND OF THE INVENTION a. The Field of the Invention

This invention relates to an apparatus for washing fabrics and more particularly to an apparatus for continuously, uniformly and thoroughly washing continuous pieces of fabrics, particularly knitted fabrics and the like, which are lengthwise admitted into a plurality of washing tanks while being maintained transversally spread for its full width. The apparatus washes the fabric by maintaining it in a completely immersed and tensionless or "relaxed" condition in a washing liquid bath.

b. The prior Art

This art is a known and well worked one. An apparatus which has been proven to provide satisfactory washing and treatment of continuous pieces of fabric has been described in the U.S. Pat. No. 3,646,785, corresponding to the British Pat. Specification No. 1,317,938. This prior art apparatus is provided with a plurality of washing tanks in which the continuous fabric is sequentially guided by progressed by means of pluralities of rollers including washing rollers and fabric widening rollers. The washing rollers are hollow and apertured for issuing washing liquid through their outer surfaces for full impregnation with the fabric. The widening rollers each have a helically ribbed surface so arranged that opposite sideward pulls are applied to the fabric when rotated adjacently thereto.

As set forth in the above-mentioned patent disclosures, the characteristic texture of a knitted fabric, such as those widely mass-produced by circular knitting machines and widely made use of, for example, for ladies' garments, is such that it is not adapted to resist tensions. It is subject to elongation in any direction in which a pull is exerted thereon. Additionally, such knitted fabrics are subject to curl or roll-up, particularly when wet, from the edges towards the center portion of the piece of fabric. On the other hand, such fabrics can be, and generally are, ornamented by printing processes and require a very careful final treatment, principally a so-called "finishing" treatment including a plurality of preliminary and of forced final immersion washing steps. The combined action of the washing and widening rollers of the prior art apparatus described above which are positioned beneath the level of the liquid baths that are maintained and recycled into washing tanks, has been proven capable of ensuring a generally satisfactory treatment for the fabtric, especially when the same was maintained well open and fully spread and slightly tensioned in the longitudinal and/or transversal directions.

It has, however, been found that a more satisfactory washing will occur if the washing treatment includes at least one step in which the fabric is maintained immersed in a completely tensionless condition, the condition being generally termed in the art as a "relaxed condition". Such a relaxed condition has heretofore been believed to be unfeasible in the operation of a continuously-run apparatus which has roller means that are designed for continuously pulling the fabric along and through the apparatus.

Further, it has been found that after a length of fabric, in particular a knitted fabric, is immersed into and progressed along a liquid path in a tensionless condition that the proper alignment of the fabric along the predetermined path lying in the longitudinal vertical plane of symmetry of the apparatus will be seriously affected by unpredictable and uncontrollable sideward displacements of relaxed portions of the length of the fabric.

It is, therefore, a principal object of this invention to provide a new and improved apparatus for the final immersion washing of continuous lengths of fabrics, including certain new and advantageous means and devices, and combinations and arrangements of said means and devices, as set forth hereinbelow, by which a proper and efficient washing treatment can be performed in the apparatus, the treatment including the washing of the fabric in relaxed condition and the realignment of the fabric in its proper path, if and when a misalignment occurs.

SUMMARY OF THE INVENTION

According to the invention, there is provided an immersion washing apparatus including a plurality of sequentially arranged washing tanks and roller means for continuously and guidingly progressing a continuous length of fabric from one to the others of said tanks, said roller means including widening rollers means having helical ribs capable of exerting oppositely sidewardly-directed pulls on either side portion of the fabric contacting said roller. The apparatus comprises at least one of said washing tanks, a rotary drum having vanes extending radially thereof and forming therebetween spaces wherein successive portions of the fabric length can be entrapped, maintained in relaxed condition and immersed into and carried out of the liquid bath in said tank in said relaxed condition. The widening rollers means includes at least a composite widening roller, located downstream of said one tank, including co-axially symmetrically helically-ribbed half roller side parts each individually connected to separately controlled sources of rotary motion. Moreover, sensor means are positioned to sense the actual position of the fabric relative to the predetermined plane of symmetry of the apparatus, said sensor means providing and applying a signal to said sources of rotary motion for selectively accelerating the roller side part toward which an extra lateral pull is to be exerted on the fabric for counteracting a misalignment detected by said sensor means relative to said plane of symmetry.

These and other features and advantages of the invention will be best apparent from the following detailed description of a preferred embodiment thereof, taken in conjunction with the accompanying drawings, wherein the essential components of the new apparatus have been diagrammatically illustrated. The various structural details and complemental means and devices which individually are known in the art have been omitted for simplicity.

BRIEF DESCRIPTION OF THE DRAWINGS

FIG. 4 is a sectional vertical view of a complete washing unit wherein the fabric is immersion washed in relaxed condition;

FIGS. 5A and 5B are fragmentary transversal sectional views, with some components in side view, of the unit of FIG. 4; and FIG. 6 is a transversal vertical sectional view of a final drying unit, also illustrated in FIG. 1, with which the apparatus is advantageously complemented.

DETAILED DESCRIPTION OF THE PREFERRED EMBODIMENT

Figures 1, 2, 3:
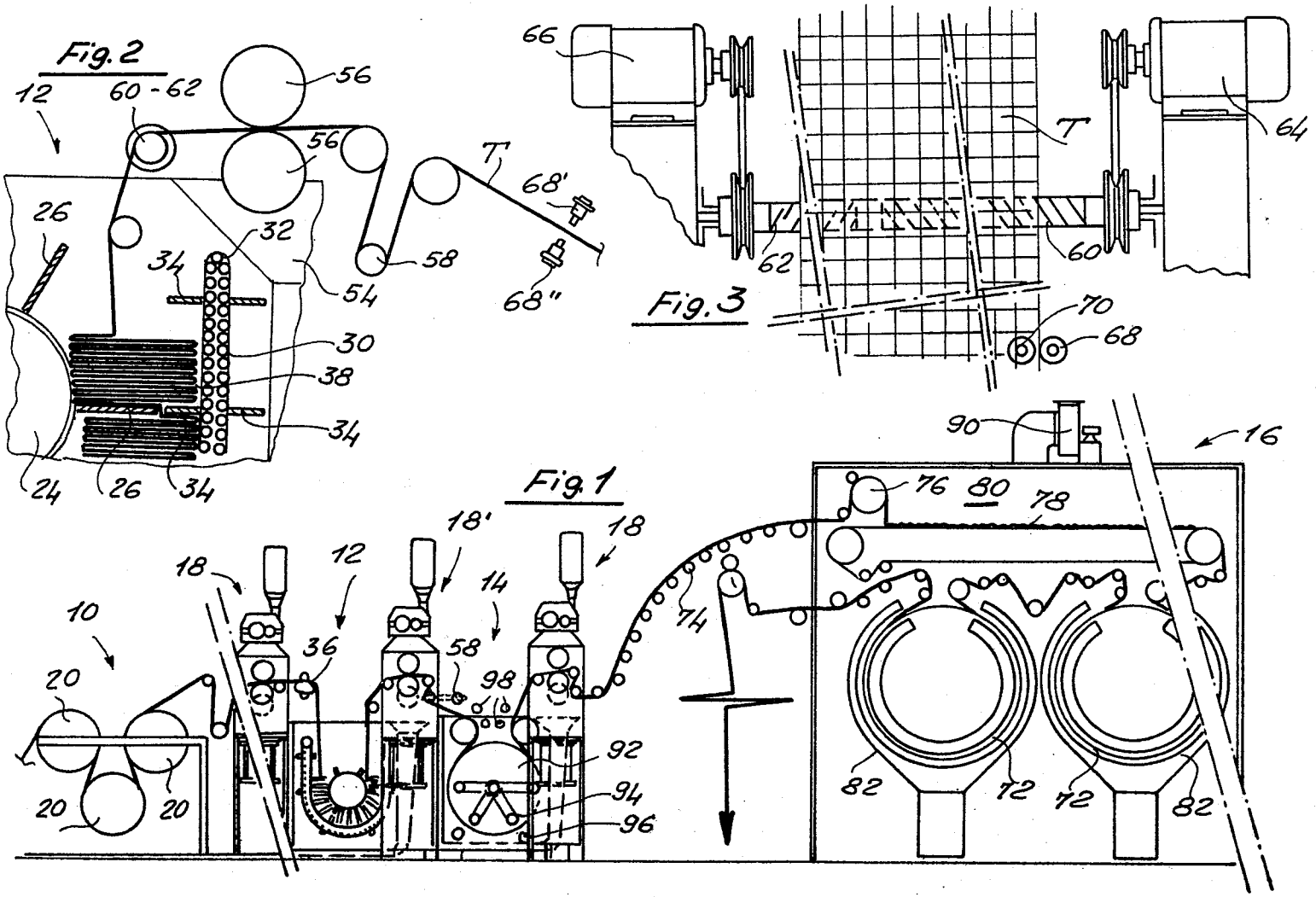
FIG. 1 is a broken-away sectional view of the apparatus, taken in its longitudinal vertical plane of symmetry.
FIG. 2 is a broken-away view which illustrates in enlarged scale and in somewhat greater detail a part of a tank wherein the fabric is immersion washed in tensionless condition.
FIG. 3 is a fragmentary view of a fabric lateral misalignment sensing and correcting device, as seen on a plane containing the progressing fabric.

Referring initially to FIG. 1, there is shown the critical minimal combination of units which are necesssary for performing a complete final treatment of the kind considered above, in an apparatus according to the invention, for immersion washing of continuous lengths of fabrics. Such units comprise at least one preliminary washing unit 10; at least one unit 12 for immersion washing the fabric in relaxed condition, wherein the fabric can be considered as relatively "stationary" in the liquid bath (it will be understood that the fabric is not stationary in unit 12, but is described as relatively stationary in consideration of the relatively long amount of time that the fabric is present in the bath due to the very slow advancement of the fabric in the unit 12); at least one unit 14 of "forced" washing, wherein the liquid is forced through the fabric; and a drying unit or plant 16. Downstream of each washing unit, such as units 10, 12 and 14, a fabric progressing mechanism 18′, is provided. Such mechanisms 18′, comprise, according to the current art, pairs of fabric driving rollers, squeezing rollers and suitable means for transferring the fabric from the upstream to the downstream unit.

Of course, in the actual manufacture of the apparatus, and according to the specific requirements of the processing of the fabrics, the apparatus can well include two or more of the above-described series of units 10–18.

According to the invention, at least one progressing mechanism 18, including the mechanism indicated at 18′ downstream of the unit 12 where the fabric is washed in relaxed condition (that is, in a condition where the fabric is most subject to misalignment since it is not being retained by tension-applying means), is provided with a misalignment-correcting device, which will be described below in detail with reference to FIG. 3.

The preliminary washing unit (or units) 10 is preferably provided with three rotary drums 20 conventionally provided with a wire net cylindrical surface through which pressurized water can be outwardly sprayed by suitable spray-nozzles (not shown).

The unit (or units) 12 enbody a substantial improvement over the prior art. As shown in FIGS. 1, 2, 4, 5A and 5B, the unit 12 comprises a tank 22 wherein the washing bath liquid is maintained at a level such as indicated at L. A drum 24 is rotatably supported in the tank 22 and is about half-way immersed in the liquid. A plurality of radial vanes 26 are secured to and radially extend from said drum. Toothed wheels 28 are co-axially secured at both axial ends of the drum 24, and the diameter of said wheels is slightly greater than that defined by the outer edges of the vanes 26. Sprocket chains 30 engage the lower half of toothed wheels 28 and are arranged to revolve in U-shaped closed loops by pinions 32 (FIGS. 2 and 4) which are well above the level L. Vanes or planks 34 are secured to said chains 30 in a predetermined spacing and phase relationship along the elongation thereof so that, when such chains remove about the wheels 28, said planks will assume a plurality of end-to-end adjacent and co-planar positions with the radial vanes 26. As shown in FIGS. 2 and 4, the vanes 26, when rotated to a horizontal position, cooperate and register with the respectively adjacent and co-planar planks 34 in order to form a planar horizontal support surface. Similarly, the pairs of co-planar vanes 26 and planks 34 form, about the lower half of the drum 24, essentially closed spaces even while the drum 24 continues to rotate.

As shown in FIG. 1, the fabric is fed from above upon one of such formed support surfaces and laid thereover in lapping fashion, by means of a conventional lapping device 36 (or by means of a pair of rollers 50, FIG. 4, mechanically reciprocated in the directions indicated by the illustrated small arrows), until a proper amount 38 of the fabric is folded and collected. The drum 24 is inter-mittently driven by a suitable source of power (not shown and easily conceivable by those skilled in the art) so that the successively formed amounts 38 of fabric are first immersed below the level L, and then slowly and in steps carried below the drum where it is thus immersion washed in a completely tensionless condition. Consequently, the fabric is maintained immersed in the bath for an extended holding time, neither pressed nor tensioned, thereby resulting in a proper and continuous immersion washing.

The washing liquid is preferably continuously recycled by means such as those shown in FIG. 5A. Apertured tubes 40, located within the drum 24, which is also apertured or formed by a wire network, are connected by a duct 46 to the inlet of a pump 42 that is driven by a motor 44. The outlet of the pump 42 is connected by a duct 48 to apertured pairs of pipes 50 and 52 (FIG. 4) so that the re-cycled liquid falls on the incoming and the outgoing delivered fabric. The pair of pipes 50 can form the reciprocating-folding or distributing pair of rollers or a stationary pair of rollers for overlapping the fabric being fed into the unit.

As the fabric exits from any washing unit, it is squeezed between conventional pairs of squeezing rollers (diagrammatically shown in FIG. 1). The squeezed-off liquid is collected by hopper means, one of which is indicated at 54 in FIGS. 4, 5A and 5B.

The relatively long holding or washing time in tensionless condition of the fabric in the unit 12 leads to a somewhat lateral displacement and disorder of the fabric. Therefore, at least the mechanism 18′ downstream of unit 12 is provided with the device shown in FIGS. 2 and 3. A widening roller, such as the roller engaging the fabric T issuing from below, consists of two co-axial half-rollers 60 and 62 having oppositely coiled helical ribs (the operation of such widening rollers having been described in the above-described prior U.S. and British patent publications), each adapted to exert a transverse pull on the fabric. The half rollers are individually driven by separate motors 64 and 66 respectively. Assuming that these half rollers are concurrently driven at the same speed, they will jointly act to operate as a widening roller.

At a proper location, such as downstream of a pair of squeezing rollers 56 and of a tensioning dancer roller 58 (such devices are known and therefore are not described in detail herein) sensor means 68 and 70 are each located on opposite sides of one of the edges of the fabric T. In FIG. 3, the sensor means 68 and 70 have their opposing sensor positions on the right side of the fabric although they can equivalently be provided on the left side of the fabric. Each sensor means can comprise, for example, a photocell sensor portion and a source of light sensor portion which is adapted for exciting the photocell, such as is diagrammatically illustrated at 68' and 68'' in FIG. 2. The sensor means are so positioned, that when the fabric T is properly aligned in the apparatus, the sensor 70 "feels" the fabric while the sensor 68 does not.

As shown in FIG. 3, if the fabric were misaligned towards the right, the sensor 68 will sense the presence of the fabric, while a leftward misalignment will cause the sensor 70 to no longer sense the presence of the fabric. The sensor means 67, 70 are connected by suitable conventional circuitries the power sources of motors 64 and 66 so that a signal provided by such means, indicating the occurrence of a misalignment, will cause the half roller 60 or 62, which applies the transverse pull to the fabric T, in the direction necessary to compensate such misalignment, to accelerate and thus to center the fabric. This action will be discontined as soon as the sensors will sense the proper normal position of the fabric. Of course, such sensor means can be of other different types of constructions. For example, a pair of rollers may be used to contact the opposite sides of the fabric, or a pair of pneumatic sensors including a nozzle which issues a jet of air against the fabric may be utilized. The signal, in both cases, is provided by the difference of pressure resulting from the fact that the roller or jet impinges or not upon the fabric, and so on. The sensor means, as before, generate the signals in order to actuate the proper motor.

The apparatus is preferably complemented by a drying unit such as generally indicated at 16 in FIG. 1, some details of which are shown in FIG. 6. Such a drying unit comprises a plurality of drums 72 about which the fabric is carried while being dried. The fabric is admitted into the unit 16 over a bed of rollers 74 and is driven by a progressing roller 76, from which it is laid in tensionless condition over a conveyor belt 78 in the upper portion of the chamber 80 of the dryer. The drums 72 are nearly completely encased within shaped boxes 82 and 84 which are connected to suction fans 86 and 88. A further fan 90 is connected to the top of chamber 80.

It is evident that the invention might be subjected to several modifications as to its details without departing from the spirit and scope thereof.

We claim:

1. In an apparatus for the continuous immersion washing of an uninterrupted length of fabric tending to curl when subject to longitudinal pull, a combination comprising a plurality of washing stations including at least one washing container adapted to contain washing liquid at a predetermined level; a rotary member adapted to be partially immersed in the washing liquid and mounted for rotation about a horizontal axis; drive means for intermittently rotating said rotary member about said axis, said drive means including a pair of gears connected to opposite axial ends of said rotary member and a pair of endless elongated sprocket chains trained about said gears; a plurality of radially extending first vanes distributed about said rotary member; a plurality of second vanes extending transversely of and distributed along the elongation of said chains in a predetermined spacing and phase relationship, successive ones of said second vanes being respectively aligned in coplanar positions with successive ones of said first vanes in end-to-end relationship so as to form during rotation of said rotary member, at least in a region immediately above and below said predetermined level, substantially horizontal platforms upon which the fabric is deposited, adjacent pairs of said first and said second vanes forming essentially closed spaces when said rotary member moves through the washing liquid, and the fabric being maintained and carried essentially entirely between said adjacent pairs of vanes in said closed spaces in an essentially tensionless condition; and reciprocating means for feeding successive portions of the fabric intermediate said rotary member and said chains so as to deposit and fold the successive portions of the fabric overlapping relationship onto respective ones of said platforms formed above said predetermined level of the liquid.

2. A combination as defined in claim 1; and further comprising means for uniformly spreading the fabric along its width, including at least one widener roller having a cylindrical base surface which is provided with helically-arranged ribs, said ribs being adapted to sidewardly pull the fabric when rotated adjacently thereto.

3. A combination as defined in claim 1; and further comprising guiding means downstream of said container comprising a pair of axially-aligned rollers, each of said rollers having oppositely-directed helical ribbing on the outer peripheral surfaces thereof; and further comprising a pair of rotary power units for independently rotating each of said axially-aligned rollers so as to apply transverse pulls to the fabric depending upon the relative rotary speed of one of said axially-aligned rollers with respect to the other.

4. A combination as defined in claim 3; and further comprising sensor means for detecting misalignment of the fabric with respect to its normal centered position on said pair of axially-aligned rollers, said sensor means being operative to generate and direct control signals to said power units and thereby adjust the relative speeds of said axially-aligned rollers, whereby asymmetrical pulls are exerted on the fabric to return the latter to its normal centered position.

5. A combination as defined in claim 4, wherein said sensor means includes a pair of adjacent sensor elements, each located at one of the edge regions of the fabric.

6. A combination as defined in claim 4, and further comprising squeezing roller means for squeezing liquid from the fabric, said squeezing roller means being located intermediate said guiding roller means and said sensor means.

7. A combination as defined in claim 5, wherein each of said sensor elements have two coacting sensing portions facing each other.

8. A combination as defined in claim 7, wherein said coacting sensing portions of one of said pair of sensor elements is positioned on opposite sides of the fabric so as to generate a first control signal when the fabric is in said normal centered position, and wherein said coacting sensing portions of the other of said pair of sensor elements is positioned transversely and outwardly of the normal centered position of the fabric so as to generate a second control signal when the fabric is misaligned.

9. A combination as defined in claim 7, wherein said coacting sensing portions are a light source and a photoelectric cell respectively.

10. A combination as defined in claim 7, wherein one of said coacting sensing portions is a nozzle from which jets of pressurized air are issued towards the plane containing the adjacently progressing fabric.

11. A combination as defined in claim 1, wherein said gears have circumferentially-distributed teeth, and said chains are closed loops which are uprightly mounted and mesh with said teeth; and further comprising pinion means positioned for receiving the vertically-extending runs of said chains.

* * * * *